US011874057B2

(12) United States Patent
Raventos et al.

(10) Patent No.: US 11,874,057 B2
(45) Date of Patent: Jan. 16, 2024

(54) PROCESS TO SEPARATE NITROGEN FROM METHANE BY PERMEATION AND CRYOGENIC DISTILLATION

(71) Applicant: L'Air Liquide, Societe Anonyme pour l'Etude et l'Exploitation des Procedes Georges Claude, Paris (FR)

(72) Inventors: Martin Raventos, Champigny-sur-Marne (FR); Paul Terrien, Syracuse, NY (US)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 362 days.

(21) Appl. No.: 17/377,967

(22) Filed: Jul. 16, 2021

(65) Prior Publication Data

US 2023/0022033 A1 Jan. 26, 2023

(51) Int. Cl.
*F25J 3/02* (2006.01)

(52) U.S. Cl.
CPC ..... *F25J 3/0295* (2013.01); *F25J 3/0233* (2013.01); *F25J 3/0257* (2013.01); *F25J 2200/20* (2013.01); *F25J 2205/40* (2013.01); *F25J 2205/80* (2013.01); *F25J 2280/50* (2013.01)

(58) Field of Classification Search
CPC ..... F25J 3/0295; F25J 3/0233; F25J 3/0257; F25J 2200/20; F25J 2205/40; F25J 2205/80; F25J 2280/50
See application file for complete search history.

(56) References Cited

U.S. PATENT DOCUMENTS 5,647,227 A * 7/1997 Lokhandwala ..... F25J 3/0233 62/624
5,669,958 A 9/1997 Baker et al.
6,425,267 B1 7/2002 Baker et al.
6,630,011 B1 10/2003 Baker et al.

OTHER PUBLICATIONS

Lokhandwala, et al., "Membrance Separattion of Nitrogen from Natural Gas: A Case Study from Membrane Synthesis to Commercial Deployment," J. Membrane Sci., vol. 346, p. 270-279.
Pathare, et al., "Design of Membrane Cascades for Gas Separation," J. Membrane Sci., vol. 364, p. 263-267.

* cited by examiner

*Primary Examiner* — Nael N Babaa
(74) *Attorney, Agent, or Firm* — Justin K. Murray

(57) ABSTRACT

A process for the separation of nitrogen from a feed stream containing at least methane and nitrogen, with a methane content between 4 and 12% mol. consists of at least the following steps: separation of the feed stream by means of a rubbery-type membrane to produce a permeate enriched in methane at a pressure greater than 2 bara and a non-permeate which is a nitrogen-enriched residue gas at a pressure greater than 2 bara and processing of the high-pressure residue gas in a cryogenic separation unit to produce a methane rich liquid and a nitrogen-enriched gas wherein the pressure of the membrane permeate is controlled as a function of the nitrogen concentration in the nitrogen-enriched gas.

20 Claims, 1 Drawing Sheet

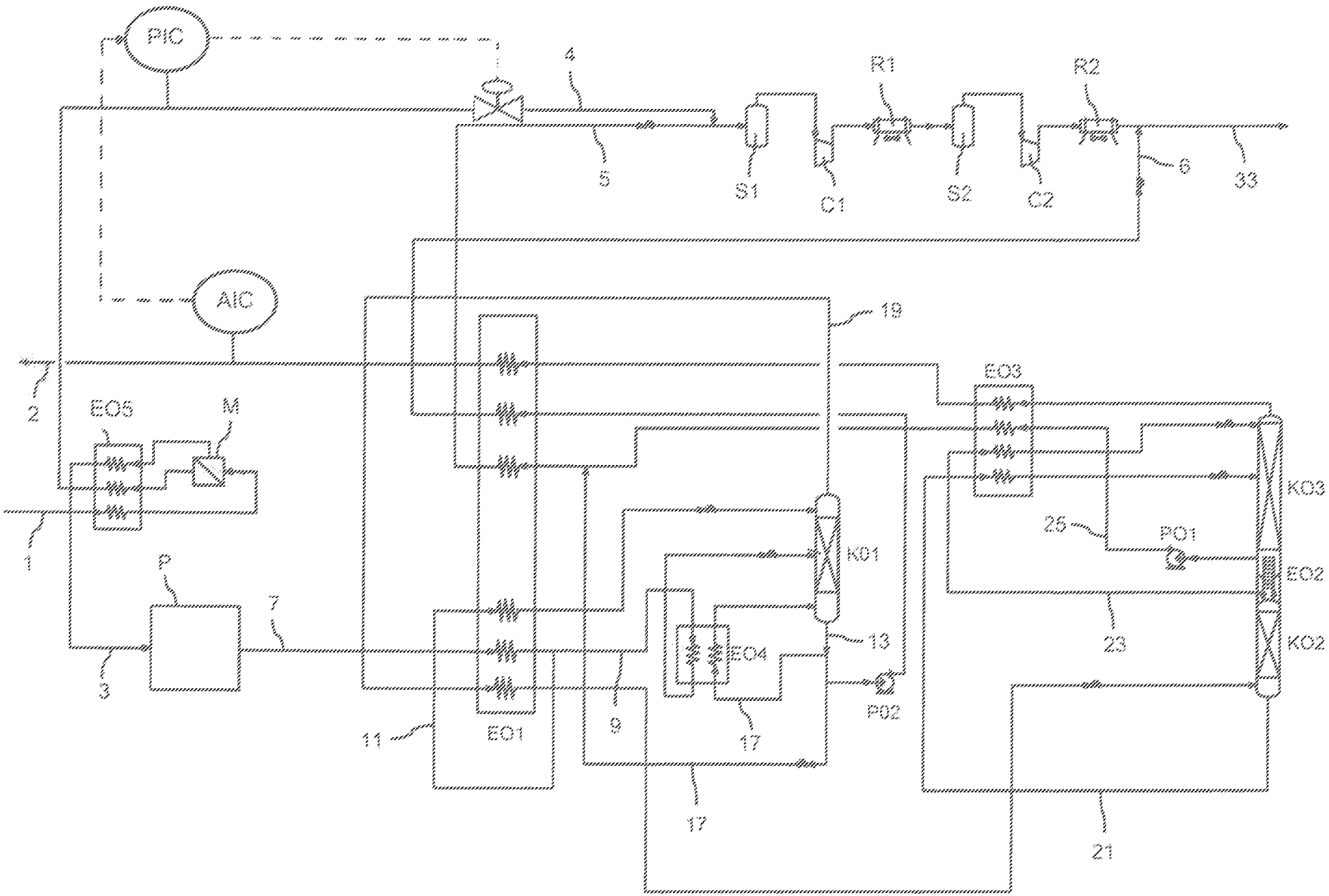
KO3
EO2
KO2
33
6
PO1
R2
23
21
25
C2
EO3
S2
R1
19
KO1
13
PO2
C1
S1
EO4
17
17
9
5
4
EO1
11
7
AIC
M
PIC
P
EO5
3
2
1

PROCESS TO SEPARATE NITROGEN FROM METHANE BY PERMEATION AND CRYOGENIC DISTILLATION

TECHNICAL FIELD OF THE INVENTION

The present invention relates to a process to separate nitrogen from methane by permeation and cryogenic distillation.

BACKGROUND OF THE INVENTION

In particular it relates to a method for separation of nitrogen from a methane containing stream, which may for example be natural gas or biogas.

Other components that can be present, in addition to $CH_4$ and $N_2$, include higher hydrocarbons (e.g., benzene, ethane, propane, butane, pentane, hexane, heptane, toluene, etc.), carbon dioxide ($CO_2$), carbon monoxide (CO), hydrogen gas ($H_2$), helium (He), hydrogen sulfide ($H_2S$), ammonia ($NH_3$), water vapor, etc. Water can be present in any amounts. Feeds that contain particulate matter can be purified using a suitable filtration device, for example.

Specific examples of mixtures that comprise $CH_4$ and $N_2$ include natural gas (such as but not limited to traditional natural gas, shale gas, associated gas) and biogas (such as but not limited to gas from digesters, landfills, etc.). In biogas, $N_2/CH_4$ ratio can range typically from 0-1% mol. (in which case no particular nitrogen removal treatment is required) to 10% mol. or more. Natural gas usually contains very small amounts of nitrogen compatible with pipeline specifications but some natural gas fields contain higher amount of nitrogen ranging from a few percent up to close to 100% in some extreme cases. In some cases, the biogas and natural gas field contain only a limited amount of nitrogen (typically from 3-4% mol. up to 10-15% mol.).

The membranes are selected based on their performance for the desired separation, that of $CH_4$ and $N_2$, for instance. Possible membranes that can be employed are described in U.S. Pat. Nos. 5,669,958 and 6,630,011B1. Membranes having the potential to effect the $CH_4$-$N_2$ separation often include rubbery membranes such as those having a rubbery separation layer. Some potential examples of materials that can be employed for the separation layer include poly (dimethyl siloxane) (PDMS), e.g., homopolymers of dimethylsiloxane, and copolymers of dimethyl siloxane with methylethyl siloxane, methyl propyl siloxane, methyl butyl siloxane, methyl pentylsiloxane, methyl hexyl siloxane, methyloxtyl siloxane, methyl phenyl siloxane. The rubbery material can include block copolymers of dimethylsiloxane or methyloctylsiloxane with polyarylethers, polyamides, polyesters, polyketones, polyimides or block copolymers of dimethyl siloxanes or methyl octyl siloxane with silicates. Another possible material is a ladder-type silicone block copolymer with a general formula of:

$$HO\{[C_6H_5SiO_{1.5}]_n[Si(CH_3)_{2O}]_m\}H, \text{ where } n=30\text{-}60 \text{ and } m=80\text{-}130.$$

The stream preferably contains less than 13% mol, nitrogen, possibly less than 10% mol. nitrogen and even less than 7% mol. nitrogen.

Nitrogen can often be found in biogas or in natural gas. While not presenting a major problem for some applications, nitrogen generally reduces the heating value of natural gas. Although small amounts of this inert gas can often be tolerated, natural gas containing levels higher than 4-5% vol. of $N_2$ is typically unacceptable.

Various approaches can be employed to reduce nitrogen levels. The most common rejection technology relies on cryogenic separation. While relatively efficient, the cryogenic removal of $N_2$ can requires large equipment and balance of plant, rendering this approach uneconomical in some situations, particularly for small flow rates.

Membrane separation is a very cost effective and simple way to separate gases. Separating $CH_4$ and $N_2$, however, has proved to be challenging. Some rubbery membranes such as poly(dimethylsiloxane) and derivatives, poly(methyloctylsiloxane, and polyamide-polyether copolymer can achieve a $CH_4/N_2$ selectivity of 2 to 4. Generally, this is not found satisfactory for generating a high product purity and good product recovery.

It is known that the $CH_4/N_2$ selectivity can be increased at low temperatures (below 0° C.). U.S. Pat. No. 5,669,958 to Baker et al., for example, describes operating polysiloxane membranes at temperatures as low as −50° C., for a $CH_4/N_2$ selectivity of up to 6, to remove N2 and generate pipeline quality gas with high methane recovery. The method described in this patent utilizes a turbo-expander to supply the cooling required by the process.

In U.S. Pat. No. 6,425,267 to Baker et al., a two- or three-stage membrane process for $CH_4/N_2$ separation is conducted at an intermediate low temperature such that high $CH_4$ recovery is achieved without the use of external refrigeration or turbo-expansion. The incoming feed gas is cooled to a sub-ambient temperature by a combination of residue and permeate streams; the cooling is generated by the Joule-Thomson effect of the membranes.

U.S. Pat. No. 6,630,011 B1 to Baker et al. describes a separation of CH4 and N2 that uses a multi-stage membrane process to achieve high methane recovery. The process is optionally operated fully or partially at low temperature for enhanced performance.

In a publication by K. A. Lokhandwala et al, several two stage and three stage arrangement membrane processes for nitrogen removal were discussed, see K. A.

Lokhandwala et al., J. Membrane Sci., vol. 346, page 270-279, titled "Membrane separation of nitrogen from natural gas: A case study from membrane synthesis to commercial deployment".

In a publication by R. Pathare and R. Agrawal., all five possible different membrane arrangements for two stage or three stage design are listed based on membrane cascade schemes, see R. Pathare and R. Agrawal, J. Membrane Sci., vol. 364, page 263-267, titled "Design of membrane cascades for gas separation".

Both of the following techniques are known to separate methane and nitrogen:

- Cryogenic separation with various embodiments
  - Single column processes—works generally well for any type of separation but may require a lot of compression energy (not the most efficient process)
  - Double column processes—a very efficient process for a narrow range of feed composition (typically around 40% mol $N_2$ and 60% mol $CH_4$)
  - Three column processes—a very efficient process extending the applicability of the double column process but still limited by a minimum $N_2$ content in the feed in order to perform acceptable separation (typically more than 10% mol)
  - Two column processes—a very efficient process that consists in a simplification of the three column processes wherein the second column is replaced by a separator Membrane separation using either rubbery or glassy membranes Glassy membranes usually achieve poor separation performances but have the benefit of producing the valuable product (methane) at high pressure Rubbery membranes can show better performances, particularly when used at cold temperatures, but produce methane on the low pressure/permeate side Generally, cryogenics works well but investment costs are usually high and a single column process is not very efficient.

Generally, membranes can work only in complex multi-stage and energy intensive schemes. This invention relates to a method for separating nitrogen from a methane-containing feed stream using membranes and cryogenics. The membrane is used to bridge the gap between the feed stream composition, which is not suitable for a very efficient cryogenic NRU process, and the composition required to run such efficient cryogenic process. In an example of such method (see mass balance) a high-pressure (~70 bar) feed stream containing ~6% mol nitrogen, must be enriched to approximately 13% mol. nitrogen to be treated in an efficient cryogenic NRU.

The cryogenic unit will produce medium to high-pressure, methane-rich products with various nitrogen contents, which can be combined with the membrane permeate and compressed to the final product pressure in a single or multiple compressor(s). The nitrogen content of each of the methane-rich products from the cryogenic NRU can be adjusted so that the final methane-rich product meets the required specification regarding the nitrogen or total inert content.

In order to optimize the operation of the membrane to maximize the methane recovery while maintaining a target product concentration and a high methane recovery for the combined methane product, certain embodiments of the invention provide a control process.

By this process, the pressure of the membrane permeate is controlled using a control valve with a pressure indicator and controller (PIC) detecting the pressure of the permeate. The higher the pressure of permeate, the lower the flow rate of the permeate and the lower the nitrogen concentration in the permeate. If the permeate flowrate decreases, the non-permeate flowrate necessarily increases and thus the flow rate sent to the cryogenic unit increases, at the same time as the nitrogen concentration in the non-permeate feeding the cryogenic unit decreases. This should generally have the effect of reducing the overall methane recovery for the entire process (permeation and cryogenic separation) by increasing the content of methane in the nitrogen rejected from the cryogenic separation. The pressure level of the permeate is optimized, for example manually, to maximize that methane recovery which can be monitored with an analyzer on the waste stream. Alternatively an automatic control/cascade can be installed with AIC on stream W05 in cascade of the PIC on stream P01.

SUMMARY OF THE INVENTION

According to the present invention, there is provided a process for the separation of nitrogen from a feed stream containing at least methane and nitrogen, with a methane content between 4 and 12% mol., preferably between 5 and 10 mol. %, consisting of at least the following steps:

a) Separation of the feed stream by means of a rubbery-type membrane to produce a permeate enriched in methane at a pressure greater than 2 bara and a non-permeate which is a nitrogen-enriched residue gas at a pressure greater than 2 bara b) Processing of the high-pressure residue gas in a cryogenic separation unit to produce a methane rich liquid and a nitrogen-enriched gas wherein the pressure of the membrane permeate is controlled as a function of the nitrogen concentration in the nitrogen-enriched gas.

According to optional features:

the pressure of the membrane permeate is increased if the nitrogen concentration in the nitrogen-enriched gas increases.

the pressure of the membrane permeate is decreased if the nitrogen concentration in the nitrogen-enriched gas decreases.

the pressure of the membrane permeate is varied using a valve on a conduit into which the membrane permeate flows the feed stream is cooled upstream of the membrane by indirect heat exchange with at least one of the permeate and the non-permeate.

the feed stream and the products of the separation are the only fluids indirectly exchanging heat in the heat exchanger.

the feed stream is cooled in a first heat exchanger by indirect heat exchange with at least one of the permeate and the non-permeate and the non-permeate is cooled in a second heat exchanger distinct from the first heat exchanger by indirect heat exchange with at least one fluid produced in the cryogenic separation unit.

the cryogenic separation unit comprises at least one distillation column.

the cryogenic separation unit comprises at least first and second distillation columns, the cryogenic separation unit comprises at most three distillation columns.

the feed stream is cooled upstream of the rubbery type membrane by indirect heat exchange with at least one of the permeate and the non-permeate.

The process may further comprise

A stream derived from the high pressure residue gas is introduced into the first distillation column to produce a nitrogen-rich gas stream and an impure methane liquid stream containing at least 5% mol. nitrogen At least partially condensing at least part of the nitrogen-rich gas stream in a heat exchanger to produce a nitrogen rich stream Sending at least part of the liquid nitrogen rich stream to the second distillation column to be separated Separating the at least part of the liquid nitrogen rich stream to form a methane enriched liquid Sending at least part of the methane enriched liquid to the third distillation column at a first height Condensing a top gas of the second distillation column In a bottom reboiler of the third distillation column Sending a liquid nitrogen rich stream from the top of the second distillation column into the third distillation column at a height above the first height, A methane rich bottom liquid is recovered from third distillation column and pumped to a medium pressure of at least 3 bara and At least part of the permeate from step a), at least part of the impure methane liquid stream and at least part of the methane rich bottom liquid from step b) viii. are combined to form methane product.

the first distillation column operates at a first pressure and the second distillation column operates at a second pressure, the second pressure greater than the first pressure by at least 5 bars.

no external source of refrigeration is used in the process.

the only compressor or compressors pressurizing a gas is or are methane product compressors or feed gas compressors.

the feed stream contains between 2% mol. and 10% mol. nitrogen and wherein the high-pressure residue gas contains at least 1.1 times more nitrogen than the feed stream and at most 50% mol. nitrogen.

the feed stream contains between 10% mol. and 40% mol. nitrogen and wherein the high-pressure residue gas contains at least 1.1 times more nitrogen than the feed stream and at most 80% mol. nitrogen.

the membrane operates at a temperature less than 10° C.

the feed stream sent to the membrane is cooled to the temperature less than 10° C. by heat exchange with at least one of the permeate and non-permeate of the membrane.

the methane content of the permeate is less than the methane content of the methane rich product of the cryogenic columns.

The process may comprise at least one of the following steps:

A single-stage membrane permeation step that preferably produces a medium-pressure permeate at around 14 bar and a high-pressure residue containing approximately 13% mol $N_2$ and with a flow rate of only 28% of that of the feed stream.

The permeation step using a membrane stage operated at low temperature using a heat exchanger to cool down the feed prior to entering the membrane.

Optional removal of water and carbon dioxide from the membrane residue

Processing of the dry, $CO_2$-free, high-pressure residue in a cryogenic nitrogen rejection unit in order to produce a medium-pressure (~13 bar) methane-rich product, a high-pressure (~56 bar) methane-rich product, and a low-pressure nitrogen-rich product. Mixing of the medium-pressure, methane-rich product stream from the cryogenic NRU with the membrane permeate to form a combined medium-pressure, methane-rich product.

Compression of the combined medium-pressure, methane-rich product to ~56 bar and mixing of the resulting stream with the high-pressure, methane-rich product from the cryogenic NRU to form a combined, high-pressure, methane-rich product.

Compression of the combined, high-pressure, methane-rich product to the required final pressure (if greater than ~56 bar).

The invention now will be described more fully hereinafter with reference to the accompanying drawing, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

It will be understood that although terms such as "first" and "second" are used herein to describe various elements, these elements should not be limited by these terms. These terms are only used to distinguish one element from another element. Thus, an element discussed below could be termed a second element, and similarly, a second element may be termed a first element without departing from the teachings of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

BRIEF DESCRIPTION OF THE DRAWINGS

The invention will now be described in greater detail, referring to the FIGURE.

FIG. 1 represents a process according to the an embodiment of the invention.

DETAILED DESCRIPTION OF THE INVENTION

All described and/or depicted features on their own or in any desired combination form the subject matter of the invention, irrespective of the way in which they are combined in the claims or the way in which said claims refer back to one another The process including a permeation step in block M and a further cryogenic distillation step involving three distillation columns K01, K02, K03, columns K02 and K03 being thermally linked to form a double column, with the top gas of column K02 being condensed in a bottom condenser of column K03 and thereby evaporating the bottom liquid of column K03.

A gaseous stream 1 containing at least nitrogen and methane preferably contains less than 13% mol, nitrogen, possibly less than 10% mol nitrogen and even less than 7% mol nitrogen. The stream may contain at least one component from the following list: water, carbon dioxide, benzene, ethane, propane, butane, pentane, heptane, toluene, carbon monoxide.

Gaseous stream 1 preferably contains at least 80% mol methane, still more preferably at least 90% mol methane.

The feed stream 1 may contain between 2% mol and 10% mol nitrogen.

Alternatively the feed stream 1 may contain between 10% mol and 40% mol nitrogen.

The gaseous stream 1 is cooled in a heat exchanger E05 and separated in a rubbery type membrane M to form a permeate 4 enriched in methane at at least 3 bars and a non-permeate enriched in nitrogen. The permeate 4 is warmed in heat exchanger E05.

Preferably the non-permeate 3 is at a pressure of at least 3 bara and contains at least 1.1 times more nitrogen than the feed stream 1. The non-permeate 3 may contain at most 80% mol nitrogen or at most 50% mol nitrogen.

The membrane operates at less than 10° C.

The non-permeate enriched in nitrogen is also warmed in heat exchanger E05 and then optionally purified in purification unit P to remove any components which would freeze at temperatures encountered during the distillation process, such as water, carbon dioxide to form gaseous stream 7. Stream 7 is cooled in heat exchanger E01 and divided in two, one part 11 being cooled in heat exchanger E01 and the rest being used to control the temperature of stream 9 downstream of E01. Stream 9 is sent to reboiler E04 in which bottom liquid 13, 15 from column K01 is vaporised to form a stream sent to the bottom of first distillation column K01, as reboil.

Stream 9 is condensed in heat exchanger E04 and sent to an intermediate level of column K01 as feed.

Stream 11 is the top feed for first distillation column K01.

The top stream 19 from column K01, enriched in nitrogen, is cooled in heat exchanger E01 (not at the warm end, the drawing is schematic) and is sent as gaseous feed to the bottom of column K02. Heat exchanger E01 is typically composed of several heat exchangers.

The bottom stream 13 from first distillation column K01 is enriched in methane and is divided in three. One part 15 is previously described, part 17 is warmed in exchanger E04 and the rest is pumped in pump P02, vaporised in exchanger E01 and forms stream 6.

The operating pressure of column K01 is at least 5 bars greater than that of column K02.

The bottom liquid of column K02 is cooled in subcooler E03, expanded and sent as feed to column K03. Top gas from column K02 is sent to the condenser E02 at the bottom of column K03 and part of the condensed liquid formed is sent as stream 23 to the top of the column K03.

Bottom liquid 25 is removed from column K03, pressurized in pump P01 and then warmed in subcooler E03. It Is then mixed with liquid 17 and the mixture is vaporized in exchanger E01 to form gaseous stream 5. Stream 5 is expanded in a valve, is mixed with the permeate 4 following valve expansion of permeate 4 and the two phase mixture is separated in phase separator S1. The gas from phase separator S1 is compressed in compressor C1, cooled in cooler R1, separated again in phase separator S2, compressed in compressor C2 and cooled in cooler R1 and then mixed with stream 6 to form treated methane rich gas 3.

In an alternative example, the phase separators S1 and/or S2 are not present and the mixture formed by mixing stream 4 and stream 5 remains entirely gaseous.

Top gas 2 from column K03 is a nitrogen-enriched gas which is warmed in subcooler E03 and then in exchanger E01.

The purity of the stream 2 is measured downstream of heat exchanger E01 using an analyzer AIC.

A pressure indicator and controller PIC measures the pressure of the permeate 4 and controls a valve to increase or reduce the flowrate of stream 4. The pressure indicator and controller is itself controlled by the analyzer AIC. The higher the pressure of the permeate 4, the lower the flowrate of the permeate 4 and the lower the nitrogen content in the permeate 4. If the permeate flowrate 4 decreases, the non-permeate flowrate 3 necessarily increases and thus the flowrate 7 sent to the cryogenic unit K01, K02, K03 increases, at the same time as the nitrogen concentration in the non-permeate 7 feeding the cryogenic unit decreases.

This should generally have the effect of reducing the overall methane recovery for the entire process (permeation and cryogenic separation) by increasing the content of methane in the nitrogen 2 rejected from the cryogenic separation. The pressure level of the permeate 4 is optimized, for example manually, to maximize that methane recovery which can be monitored with an analyzer AIC on the waste stream 2.

Alternatively an automatic control/cascade can be installed with the controller AIC on stream in cascade of the PIC on stream 4.

| | | Stream | | | | | | |
|---|---|---|---|---|---|---|---|---|
| | | 1 Feed gas | 2 Rejected Nitrogen | 3 Treated gas | 4 Membrane permeate | 5 MP gas from cryo | 6 HP gas from cryo | 7 Membrane residue |
| | | Flow rate | | | | | | |
| | NCMH | 28000 | 900 | 27000 | 20000 | 2640 | 4300 | 7880 |
| | | Pressure | | | | | | |
| | bara | 70 | 1 | 57 | 12 | 12 | 57 | 68 |
| | | Temperature | | | | | | |
| | ° C. | 50 | 30 | 40 | 32 | 30 | 30 | 33 |
| Composition | | | | | | | | |
| Nitrogen | mol % | 5.7 | 99.3 | 2.4 | 2.7 | 2.9 | 1.2 | 13.4 |
| Methane | mol % | 84.2 | 0.683 | 87.132 | 83.921 | 96.827 | 96.149 | 84.999 |
| Ethane | mol % | 8.9 | 0.000 | 9.283 | 11.926 | 0.242 | 2.513 | 1.452 |
| Propane | mol % | 1.0 | 0.000 | 1.037 | 1.367 | 0.007 | 0.133 | 0.075 |
| i-Butane | mol % | 0.02 | 0.000 | 0.022 | 0.029 | 0.000 | 0.002 | 0.001 |
| n-Butane | mol % | 0.042 | 0.000 | 0.043 | 0.057 | 0.000 | 0.004 | 0.002 |

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for the separation of nitrogen from a feed stream comprising methane and nitrogen, with a methane content between 4 and 12% mol, the process comprising the steps of:

a) separating the feed stream by means of a rubbery-type membrane to produce a permeate enriched in methane at a pressure greater than 2 bara and a non-permeate that is a nitrogen-enriched residue gas at a pressure greater than 2 bara;

b) processing of the high-pressure residue gas in a cryogenic separation unit to produce a methane rich liquid and a nitrogen-enriched gas; and c) measuring the nitrogen concentration of the nitrogen-enriched gas, wherein the pressure of the membrane permeate is controlled as a function of the nitrogen concentration in the nitrogen-enriched gas.

2. The process according to claim 1, wherein the pressure of the membrane permeate is increased if the nitrogen concentration in the nitrogen-enriched gas increases.

3. The process according to claim 1, wherein the pressure of the membrane permeate is decreased if the nitrogen concentration in the nitrogen-enriched gas decreases.

4. The process according to claim 1, wherein the pressure of the membrane permeate is varied using a valve on a conduit into which the membrane permeate flows.

5. The process according to claim 1, wherein the feed stream is cooled upstream of the membrane by indirect heat exchange with at least one of the permeate and the non-permeate.

6. The process according to claim 5, wherein the feed stream and the products of the separation are the only fluids indirectly exchanging heat in the heat exchanger.

7. The process according to claim 5, wherein the feed stream is cooled in a first heat exchanger by indirect heat exchange with at least one of the permeate and the non-permeate and the non-permeate is cooled in a second heat exchanger distinct from the first heat exchanger by indirect heat exchange with at least one fluid produced in the cryogenic separation unit.

8. The process according to claim 1, wherein the cryogenic separation unit comprises at least one distillation column.

9. The process according to claim 7, wherein the cryogenic separation unit comprises at least first and second distillation columns.

10. The process according to claim 7, wherein the cryogenic separation unit comprises at most three distillation columns.

11. The process according to claim 1, wherein the feed stream is cooled upstream of the rubbery type membrane by indirect heat exchange with at least one of the permeate and the non-permeate.

12. The process according to claim 1, further comprising the steps of:

i) introducing a stream derived from the high pressure residue gas into the first distillation column to produce a nitrogen-rich gas stream and an impure methane liquid stream containing at least 5% mol. nitrogen;

ii) at least partially condensing at least part of the nitrogen-rich gas stream in a heat exchanger to produce a nitrogen rich stream;

iii) sending at least part of the liquid nitrogen rich stream to the second distillation column to be separated;

iv) separating the at least part of the liquid nitrogen rich stream to form a methane enriched liquid;

v) sending at least part of the methane enriched liquid to the third distillation column at a first height;

vi) condensing a top gas of the second distillation column In a bottom reboiler of the third distillation column;

vii) sending a liquid nitrogen rich stream from the top of the second distillation column into the third distillation column at a height above the first height;

viii) recovering a methane rich bottom liquid from third distillation column and then pumping the methane rich bottom liquid to a medium pressure of at least 3 bara; and ix) combining at least part of the permeate from step a), at least part of the impure methane liquid stream and at least part of the methane rich bottom liquid from step b) viii to form a methane product.

13. The process according to claim 9, wherein the first distillation column operates at a first pressure and the second distillation column operates at a second pressure, the second pressure greater than the first pressure by at least 5 bars.

14. The process according to claim 1, wherein no external source of refrigeration is used in the process.

15. The process according to claim 1, wherein the only compressor or compressors pressurizing a gas is or are methane product compressors or feed gas compressors.

16. The process according to claim 1, wherein the feed stream contains between 2% mol. and 10% mol. nitrogen and wherein the high-pressure residue gas contains at least 1.1 times more nitrogen than the feed stream and at most 50% mol. nitrogen.

17. The process according to claim 16, wherein the feed stream contains between 10% mol. and 40% mol. nitrogen and wherein the high-pressure residue gas contains at least 1.1 times more nitrogen than the feed stream and at most 80% mol. nitrogen.

18. The process according to claim 1, wherein the membrane operates at a temperature less than 10° C.

19. The process according to claim 1, wherein the feed stream sent to the membrane is cooled to the temperature less than 10° C. by heat exchange with at least one of the permeate and non-permeate of the membrane.

20. The process according to claim 1, wherein the methane content of the permeate is less than the methane content of the methane rich product of the cryogenic columns.

* * * * *